US005201180A

United States Patent [19]

Girbig

[11] Patent Number: 5,201,180

[45] Date of Patent: Apr. 13, 1993

[54] METHOD AND APPARATUS FOR MONITORING THE OPERATING CONDITION OF A STEAM TURBINE

[75] Inventor: Paul Girbig, Erlangen, Fed. Rep. of Germany

[73] Assignee: Siemens Aktiengesellschaft, Muenchen, Fed. Rep. of Germany

[21] Appl. No.: 869,471

[22] Filed: Apr. 15, 1992

[30] Foreign Application Priority Data

Apr. 16, 1991 [DE] Fed. Rep. of Germany ..... 4112427

[51] Int. Cl.[5] ..... F01K 13/00

[52] U.S. Cl. ..... 60/646; 60/657; 60/667

[58] Field of Search ..... 60/646, 657, 667

[56] References Cited

U.S. PATENT DOCUMENTS 4,355,514 10/1982 Reifenberg ..... 60/657 X
4,866,940 9/1989 Hwang et al. ..... 60/646

FOREIGN PATENT DOCUMENTS 2032143 1/1971 Fed. Rep. of Germany .
2127431 2/1972 Fed. Rep. of Germany .
2209943 9/1973 Fed. Rep. of Germany .
60-43103 3/1985 Japan .
1170177 7/1985 U.S.S.R. .

*Primary Examiner*—Allen M. Ostrager

*Attorney, Agent, or Firm*—Herbert L. Lerner; Laurence A. Greenberg

[57] ABSTRACT

A method for monitoring the operating condition of a steam turbine, to which an adjustable inlet steam quantity can be supplied and from which a variable, partially expanded steam quantity can be extracted, includes initially ascertaining a relative inlet steam quantity for an adjustable inlet steam quantity as a percentage value, and ascertaining a relative turbine power from the relative inlet steam quantity as a percentage value; and determining an applicable operating point from the relative inlet steam quantity and the relative turbine power, and subsequently displaying the applicable operating point inside a performance graph for various extraction steam quantities. An apparatus for monitoring the operating condition of the steam turbine includes a final control element for adjusting the inlet steam quantity, a first device connected to the final control element for converting a position signal of the final control element into a percentage value of the corresponding inlet steam quantity, a second device connected to the first device for converting the percentage value of the inlet steam quantity into a percentage value of the turbine power, and a display device connected to the first and second devices. The display device has a screen on which a particular operating point determined by the relative inlet steam quantity and the relative turbine power can be displayed in a performance graph for various extraction steam quantities.

6 Claims, 1 Drawing Sheet

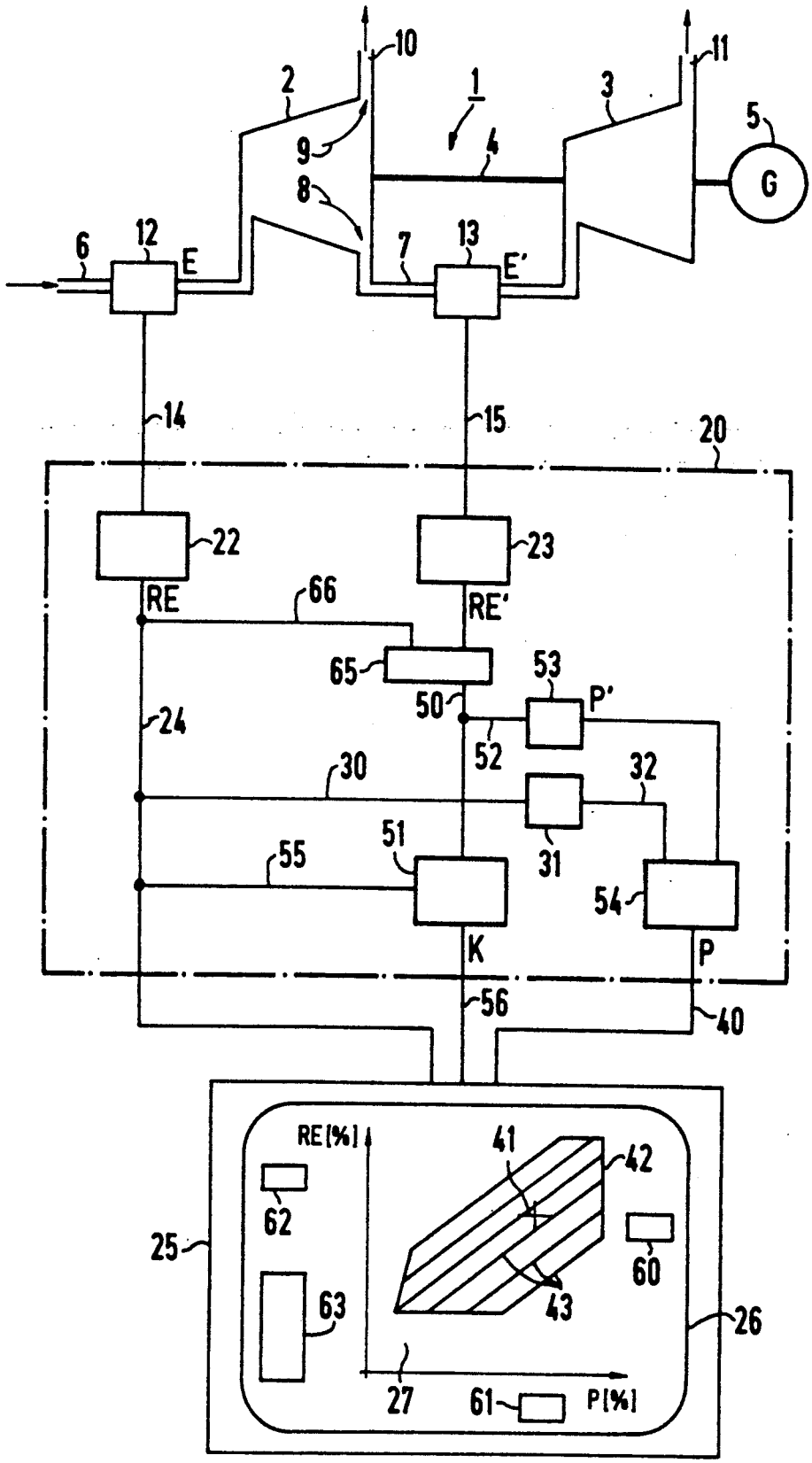
10
11
1
2
3
4
5
G
9
8
6
12
E
7
13
E'
14
15
20
22
23
RE
66
RE'
65
53
50
P'
24
52
30
32
51
31
55
54
K
P
56
40
RE[%]
41
42
62
60
25
63
43
26
27
61
P[%]

METHOD AND APPARATUS FOR MONITORING THE OPERATING CONDITION OF A STEAM TURBINE

The invention relates to a method and an apparatus for monitoring the operating condition of a steam turbine, to which an adjustable quantity of inlet steam can be supplied and from which a variable, partially expanded quantity of steam can be taken.

Such a monitoring apparatus is typically used in the control room of a power plant. In an apparatus known from German Published, Non-Prosecuted Application DE-OS 2 032 143, an applicable operating point, which is determined by the quantity of inlet steam and the power produced, is visibly displayed on a screen of a display apparatus inside an extraction steam diagram for the turbine. In order to ascertain the operating point, absolute measured values of the inlet steam quantity and the power output by the turbine generator are furnished to a scanning system of the screen. However, if absolute measured values are used, the danger exists that if the steam-condition changes, for instance if the steam pressure or temperature changes, deviations will occur between the fixedly specified extraction steam limits and the characteristic curves of the extraction steam diagram shown on the screen. Admittedly, it is possible by using electronic means to attain an adaptation to altered steam conditions by continuously updating the extraction steam diagram on the screen. However, a clear and simple display is not possible with such an expanding and shrinking extraction steam diagram.

It is accordingly an object of the invention to provide a method and an apparatus for monitoring the operating condition of a steam turbine, which overcome the hereinafore-mentioned disadvantages of the heretofore-known methods and devices of this general type and to do so in such a way that a clear and simple display is made possible by simple means, independently of alterations in the steam condition, when the operating condition of a steam turbine is monitored.

With the foregoing and other objects in view there is provided, in accordance with the invention, a method for monitoring the operating condition of a steam turbine, to which an adjustable inlet steam quantity can be supplied and from which a variable, partially expanded steam quantity can be extracted, which comprises initially ascertaining a relative inlet steam quantity for an adjustable inlet steam quantity as a percentage value, and ascertaining a relative turbine power from the relative inlet steam quantity as a percentage value; and subsequently displaying an applicable operating point determined from the relative inlet steam quantity and the relative turbine power inside a performance graph for various extraction steam quantities.

In accordance with another mode of the invention, there is provided a method which comprises ascertaining relative partial powers from relative steam quantities supplied to each of a plurality of turbine parts, and forming the relative turbine power from the sum of the relative partial powers.

In accordance with a further mode of the invention, there is provided a method which comprises ascertaining a relative extraction steam quantity from a difference in the relative steam quantities supplied to the turbine parts.

With the objects of the invention in view, there is also provided, in a steam turbine to which an inlet steam quantity can be supplied and from which a variable, partially expanded steam quantity can be extracted, an apparatus for monitoring the operating condition of the steam turbine, comprising a final control element for adjusting the inlet steam quantity, first means connected to the final control element for converting a position signal of the final control element into a percentage value of the corresponding inlet steam quantity, second means connected to the first means for converting the percentage value of the inlet steam quantity into a percentage value of the turbine power, and a display device connected to the first and second means, the display device having a screen on which a particular operating point determined by the relative inlet steam quantity and the relative turbine power can be displayed in a performance graph for various extraction steam quantities.

In accordance with another feature of the invention, the screen has display fields for displaying absolute and/or relative operating or condition variables, preferably steam pressure and steam temperature and steam quantity. This gives operating personnel additional information on the operating condition of the steam turbine.

The advantages attainable with the invention reside in particular in the fact that because of the conversion of the ascertained values for the applicable steam quantity and the corresponding turbine power in relative variables, the limits of the extraction steam diagram shown on the screen are unchanged for every actual condition. It becomes possible to monitor a steam turbine system in compact, clear and simple form on a display area that is only a few centimeters in size, regardless of the steam conditions.

The display of the operating condition of the steam turbine is advantageously performed with a crosshair inside a coordinate system, from which both the operating and power limits and the corresponding reserves of the steam turbine can be seen. In addition to the graphic display of the current operating point within the coordinate field, it is advantageously additionally possible for current measured values to be displayed digitally and for trouble reports to be incorporated in the display, marked by a color change. If adjustment interventions and trouble reports become necessary, then a jump to detailed views of the steam turbine system or to operating and trouble report tables can be made through a menu selection listed below the graphics.

Other features which are considered as characteristic for the invention are set forth in the appended claims.

Although the invention is illustrated and described herein as embodied in a method and an apparatus for monitoring the operating condition of a steam turbine, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawing.

The drawing is a diagrammatic, schematic and block circuit diagram of a steam turbine and a monitoring apparatus according to the invention, with a measuring circuit and a display device.

Referring now to the single FIGURE of the drawing in detail, there is seen a steam turbine 1 with a high-pressure turbine part 2 and a low-pressure turbine part 3. The turbine parts 2 and 3 drive a generator 5 through a common shaft 4.

The steam turbine 1 is supplied with steam through a fresh steam line 6. After expansion in the high-pressure turbine part 2, some or all of this steam is supplied through a line 7 in the direction of an arrow 8, to the low-pressure turbine part 3. As is indicated by an arrow 9, some of the partially expanded steam can be extracted at an extraction point 10 of the turbine part 2. The steam, which is expanded in the low-pressure turbine part 3, leaves the steam turbine 1 in the direction of an arrow 11 and is supplied to a non-illustrated condenser, for instance.

A final control element or valve 12 and a final control element or valve 13 are respectively incorporated in the fresh steam line 6 and the line 7. The valve 12 adjusts a steam quantity E entering the steam turbine 1. Correspondingly, the valve 13 adjusts a steam quantity E' entering the turbine part 3.

One respective signal line 14, 15 begins at each of the final control elements or valves 12 and 13. Through the use of these lines 14, 15, signals corresponding to the positions of the final control elements 12 and 13 are furnished to a device 20, which is shown in phantom lines, for measured value preparation.

The device 20 includes a first converter 22 connected to the signal line 14, and a second converter 23 connected to the signal line 15. In the converters 22 and 23, the signals corresponding to the positions of the final control elements 12 and 13 are converted, for instance on the basis of comparison values or characteristic curves, into respective percentage values RE and RE' for relative steam quantities. The percentage value RE ascertained in the converter 22 is thus equivalent to the relative steam quantity that enters the high-pressure turbine part 2 of the steam turbine 1.

The percentage value RE' ascertained in the converter 23 corresponds to a fictitious relative steam quantity, which enters from the high-pressure turbine part 2 into the low-pressure turbine part 3 of the steam turbine 1 once this steam quantity has flowed into the high-pressure turbine part 2 of the steam turbine 1.

The percentage value RE ascertained in the converter 22 is furnished over a signal line 24 to a display device 25 having a screen 26. This value RE forms a Y coordinate in a coordinate field 27 shown on the screen 26.

The percentage value RE ascertained in the converter 22 is also furnished over a line 30 to a further converter 31. In the converter 31, the relative inlet steam quantity RE is converted, for instance from a table of values stored in memory, into a percentage value P for the turbine power of the high-pressure turbine part 2. This percentage value P is likewise furnished to the display device 25, over lines 32 and 40.

The percentage value RE' ascertained in the converter 23 is furnished over a line 50 to a subtractor 51 and over a line 52 to a converter 53. Like the converter 31, the converter 53 serves to ascertain the relative or percentagewise turbine power P. To this end, a percentage value P' for the partial power of the turbine part 3, which is ascertained from the relative steam quantity RE' supplied to the turbine part 3, is added to the relative partial capacity of the turbine part 2 in a summation element 54. The relative turbine power P of the steam turbine 1 that is ascertained in this way is furnished to the display device 25 over the line 40 and forms the X coordinate in the coordinate field 27 shown on the screen 26. In the event that no steam is supplied to the turbine part 3, then only the percentage value P which is ascertained in the converter 31 and furnished to the display device 25 over the lines 32 and 40, forms the X coordinate.

An operating point defined by the X and Y coordinates is reproduced in the form of a spot of light or a crosshair or crossline 41 inside an extraction steam diagram 42. The extraction steam diagram 42 is formed by a number of characteristic curves 43 displayed on the screen 26.

In the subtractor 51, to which the percentage value RE from the converter 22 is furnished over a line 55, the relative extraction steam quantity leaving the extraction point 10 is ascertained from the difference between the percentage values RE and RE' for the steam quantities E and E' in the turbine parts 2 and 3. This percentage value K, which is ascertained in the subtractor 51, is furnished to the display device 25 over a line 56 and is displayed on the screen 26 in the form of a relative or absolute numerical value in a display field 60. In further display fields 61 and 62, numerical values for the current turbine power or inlet steam quantity, or for the positions of the final control elements or valves 12 and 13, are additionally displayed either in percent or in absolute form. In a further display field 63, the relative steam quantities supplied to the turbine parts 2 and 3 are displayed, for instance in the form of vertical bars along a percentage scale.

A selector 65, to which the percentage value RE ascertained in the converter 22 is furnished over a line 66, is incorporated into the line 50. The selector 65 compares the percentage values RE and RE' from the converters 22 and 23 with one another and corrects any values that are less than 0. For instance, such a value can occur even though the valve 13 is opened wider than the valve 12, if nevertheless because of a steam extraction, a comparatively smaller quantity of steam is flowing at the same time through the valve 13. The smaller of the two values RE, RE' is furnished to the converter 53 and the subtractor 51 over the line 50.

As a result of the monitoring of the operating condition of a steam turbine 1 on the basis of relative values RE, RE' and P for the steam quantities and the turbine power according to the invention, no difference between the specified or preprogrammed steam limits in the final control elements 12, 13 and the limits of the extraction steam diagram 42 shown on the screen 26 will arise.

The positions of the final control elements or valves 12 and 13 can also be furnished directly to the display device 25, for instance over non-illustrated signal lines connected directly to the valves 12 and 13, and can be displayed there in a further non-illustrated display field, for example in the form of vertical bars along a percentage scale.

I claim:

1. A method for monitoring the operating condition of a steam turbine, to which an adjustable inlet steam quantity can be supplied and from which a variable, partially expanded steam quantity can be extracted, which comprises:

initially ascertaining a relative inlet steam quantity for an adjustable inlet steam quantity as a percentage value, and ascertaining a relative turbine power from the relative inlet steam quantity as a percentage value; and subsequently displaying an applicable operating point determined from the relative inlet steam quantity and the relative turbine power inside a performance graph for various extraction steam quantities.

2. The method according to claim 1, which comprises ascertaining relative partial powers from relative steam quantities supplied to each of a plurality of turbine parts, and forming the relative turbine power from the sum of the relative partial powers.

3. The method according to claim 1, which comprises ascertaining a relative extraction steam quantity from a difference in the relative steam quantities supplied to the turbine parts.

4. In a steam turbine to which an inlet steam quantity can be supplied and from which a variable, partially expanded steam quantity can be extracted, an apparatus for monitoring the operating condition of the steam turbine, comprising:

a final control element for adjusting the inlet steam quantity, first means connected to said final control element for converting a position signal of the final control element into a percentage value of the corresponding inlet steam quantity, second means connected to said first means for converting the percentage value of the inlet steam quantity into a percentage value of the turbine power, and a display device connected to said first and second means, said display device having a screen on which a particular operating point determined by the relative inlet steam quantity and the relative turbine power can be displayed in a performance graph for various extraction steam quantities.

5. The apparatus according to claim 4, wherein said screen has display fields for displaying at least one variable selected from the group consisting of absolute operating variables, absolute condition variables, relative operating variables and relative condition variables.

6. The apparatus according to claim 4, wherein said screen has display fields for displaying at least one variable selected from the group consisting of steam pressure, steam temperature and steam quantity.

* * * * *